US009748050B2

(12) United States Patent
Chang

(10) Patent No.: US 9,748,050 B2
(45) Date of Patent: Aug. 29, 2017

(54) KEYSWITCH MODULE AND KEYBOARD

(71) Applicant: CHICONY ELECTRONICS CO., LTD., New Taipei (TW)

(72) Inventor: Chia-Wei Chang, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 114 days.

(21) Appl. No.: 14/607,022

(22) Filed: Jan. 27, 2015

(65) Prior Publication Data

US 2016/0118204 A1 Apr. 28, 2016

(30) Foreign Application Priority Data

Oct. 27, 2014 (TW) ..... 103219016 U

(51) Int. Cl.
*H01H 13/70* (2006.01)
*H01H 3/12* (2006.01)

(52) U.S. Cl.
CPC ..... *H01H 3/125* (2013.01); *H01H 2221/058* (2013.01)

(58) Field of Classification Search
CPC .... H01H 13/7065; H01H 13/14; H01H 13/10; H01H 3/125; H01H 2221/058
USPC ..... 200/344, 345; 400/490–496
See application file for complete search history.

(56) References Cited

U.S. PATENT DOCUMENTS 6,172,868 B1 * 1/2001 Oura ..... G06F 1/1616 200/344
6,747,867 B2 * 6/2004 Hsu ..... G06F 1/1616 200/5 A
2005/0217983 A1 * 10/2005 Hsu ..... G06F 1/1615 200/5 A
2006/0157326 A1 * 7/2006 Hsu ..... H01H 3/125 200/5 A
2008/0277254 A1 * 11/2008 Chen ..... H01H 3/125 200/341

FOREIGN PATENT DOCUMENTS

TW 438037 U 5/2001
TW 200845072 A 11/2008

* cited by examiner

*Primary Examiner* — Felix O Figueroa
*Assistant Examiner* — Lheiren Mae A Caroc
(74) *Attorney, Agent, or Firm* — Blakely, Sokoloff, Taylor & Zafman LLP

(57) ABSTRACT

A keyswitch module includes a bottom plate, a movable plate, a keycap, and a connecting assembly. The moving plate is stacked with the bottom plate and capable of moving between a first position and a second position relative to the bottom plate. The movable plate moves a horizontal stroke from the first position to the second position. The connecting assembly is operatively connected to the bottom plate and connected to the keycap. A forced portion of the connecting assembly is configured to be moved by a forcing structure of the movable plate to make the keycap move between an opening position and a closing position relative to the bottom plate. When the movable plate is located at the first position, the forcing structure and the forced portion are separated by a distance, and the keycap is located at the opening position.

14 Claims, 5 Drawing Sheets

KEYSWITCH MODULE AND KEYBOARD

RELATED APPLICATIONS

This application claims priority to Taiwanese Application Serial Number 103219016, filed Oct. 27, 2014, which is herein incorporated by reference.

BACKGROUND

Technical Field

The present disclosure relates to a keyswitch module and a keyboard.

Description of Related Art

A keyboard is an essential input device for inputting characters or numbers in a personal computer. Consumer electronics of daily life or large-scale processing equipments in industry need input devices having keyswitch structures of the keyboard in operation.

For keyswitches of a keyboard, in order to balance the force that a user applies onto each of the keyswitches, a scissors-like supporting structure is typically disposed under a keycap of the keyswitch for guiding the keycap to move vertically. The force accordingly can be evenly distributed on the keycap, regardless of whether the force is applied at an edge or a corner of the keycap. As such, the keyswitch can be easily pressed and operated by the user.

Nowadays, electronic products are rapidly developed with technological advances to have an easily-carried compact size. In this regard, the typical keyboard may acceptable to a desktop PC, but becomes a barrier for a portable notebook computer for the dimension of the keyboard acting as a bottleneck to downsize the portable notebook computer. As a result, the breaking through of this bottleneck is indeed imperative.

There is a conventional keyboard capable of lowering all keyswitches to a certain height by using a plurality of abutting structures on a plate to push the scissors-like connecting assemblies of all keyswitches when the keyboard is packed, so as to reduce the thickness of the keyboard. However, dimension requirements for each one of keyswitches are varied, which results in the different scissors-like connecting assemblies of the keyswitches. Therefore, the abutting structures on the plate must be designed with different shapes or disposed at specific positions to accommodate the differences of the keyswitches. As a result, the design costs of the keyboard increase and the manufacturing tolerances and assembly tolerances become even harder to control.

Accordingly, how to provide a keyboard capable of lowering keyswitch modules of different specifications by the same height to reduce the whole thickness to solve the aforementioned problems becomes an important issue to be solved by those in the industry.

SUMMARY

The disclosure provides a keyswitch module. The keyswitch module includes a bottom plate, a movable plate, a keycap, and a connecting assembly. The movable plate is stacked with the bottom plate and capable of moving between a first position and a second position relative to the bottom plate. The movable plate moves a horizontal stroke from the first position to the second position. The movable plate includes a forcing structure. The connecting assembly is operatively connected to the bottom plate and connected to the keycap. The connecting assembly includes a forced portion configured to be moved by the forcing structure, so as to make the keycap vertically move between an opening position and a closing position relative to the bottom plate. When the movable plate is located at the first position, the forcing structure and the forced portion are separated by a distance, and the keycap is located at the opening position.

In an embodiment of the disclosure, when the keycap is located at the opening position and the movable plate moves from the first position to the second position, the forcing structure pushes the forced portion to move a horizontal movement and moves the keycap to the closing position. The sum of the distance and the horizontal movement is equal to the horizontal stroke.

In an embodiment of the disclosure, the movable plate is stacked on the bottom plate.

In an embodiment of the disclosure, the connecting assembly is a scissors-like connecting assembly.

In an embodiment of the disclosure, the connecting assembly includes a first connecting member and a second connecting member pivotally connected to each other. The first connecting member has a pivotal end pivotally connected to the bottom plate. The forced portion is a sliding end of the second connecting member. The forced portion is slidably disposed above the bottom plate.

In an embodiment of the disclosure, the forcing structure includes a pushing portion and a retaining portion. The pushing portion is configured to push the forced portion. When the movable plate is located at the first position, the pushing portion and the forced portion are separated by the distance. The retaining portion is connected to the pushing portion and slidably engaged with the forced portion, so as to retain the forced portion relative to the bottom plate.

In an embodiment of the disclosure, the connecting assembly is a parallel linkage assembly.

The disclosure further provides a keyboard. The keyboard includes a bottom plate, a movable plate, a first keycap, a first connecting assembly, a second keycap, and a second connecting assembly. The movable plate is stacked with the bottom plate and capable of moving between a first position and a second position relative to the bottom plate. The movable plate moves a horizontal stroke from the first position to the second position. The movable plate includes a first forcing structure and a second forcing structure. The first connecting assembly is operatively connected to the bottom plate and connected to the first keycap. The first connecting assembly includes a first forced portion configured to be moved by the first forcing structure, so as to make the first keycap vertically move between an opening position and a closing position relative to the bottom plate. The second connecting assembly is operatively connected to the bottom plate and connected to the second keycap. The second connecting assembly includes a second forced portion configured to be moved by the second forcing structure, so as to make the second keycap vertically move between an opening position and a closing position relative to the bottom plate. When the movable plate is located at the first position, the first forcing structure and the first forced portion are separated by a first distance, the second forcing structure and the second forced portion are separated by a second distance different from the first distance, and the first keycap and the second keycap are located at the opening position.

In an embodiment of the disclosure, when the first keycap and the second keycap are located at the opening position and the movable plate moves from the first position to the second position, the first forcing structure pushes the first forced portion to move a first horizontal movement and moves the first keycap to the closing position, and the second forcing structure pushes the second forced portion to move a second horizontal movement and moves the second keycap to the closing position. Both of the sum of the first distance and the first horizontal movement and the sum of the second distance and the second horizontal movement are equal to the horizontal stroke.

In an embodiment of the disclosure, the first distance is equal to or larger than 0, and the second distance is larger than the first distance.

In an embodiment of the disclosure, at least one of the first connecting assembly and the second connecting assembly is a scissors-like connecting assembly.

In an embodiment of the disclosure, the first connecting assembly includes a first connecting member and a second connecting member pivotally connected to each other. The first connecting member has a first pivotal end pivotally connected to the bottom plate. The first forced portion is a sliding end of the second connecting member. The first forced portion is slidably disposed above the bottom plate. The second connecting assembly includes a third connecting member and a fourth connecting member pivotally connected to each other. The third connecting member has a second pivotal end pivotally connected to the bottom plate. The second forced portion is a sliding end of the fourth connecting member. The second forced portion is slidably disposed above the bottom plate.

In an embodiment of the disclosure, the first forcing structure includes a first pushing portion and a first retaining portion. The first pushing portion is configured to push the first forced portion. When the movable plate is located at the first position, the first pushing portion and the first forced portion are separated by the first distance. The first retaining portion is connected to the first pushing portion, so as to retain the first forced portion relative to the bottom plate.

In an embodiment of the disclosure, the second forcing structure includes a second pushing portion and a second retaining portion. The second pushing portion is configured to push the second forced portion. When the movable plate is located at the first position, the second pushing portion and the second forced portion are separated by the second distance. The second retaining portion is connected to the second pushing portion and slidably engaged with the second forced portion, so as to retain the second forced portion relative to the bottom plate.

In an embodiment of the disclosure, at least one of the first connecting assembly and the second connecting assembly is a parallel linkage assembly.

Accordingly, the keyswitch module and the keyboard of the disclosure can achieve the purpose of adjusting the height of keycaps relative to a bottom plate by horizontally moving a movable plate between a first position and a second position. When the keyboard is not used and needs to be received, a user can move the movable plate from the first position to the second position to make forcing structures on the movable plate push forced portions on connecting assemblies of keyswitch modules, so as to move the keycaps lower from an opening position to a closing position relative to the bottom plate. Meanwhile, the keycaps are at the smallest height relative to the bottom plate. When the keyboard is opened to use, the user can move the movable plate from the second position to the first position to make the forcing structures release the forced portions of the connecting assemblies, so as to move the keycaps rise from the closing position to the opening position relative to the bottom plate. Meanwhile, the keycaps are at the largest height relative to the bottom plate. Furthermore, when the movable plate of the keyboard is located at the first position, each of the forcing structures and the corresponding forced portion are separated by a distance, and the distance is determined by the horizontal movement with which each of the forcing structures pushes the corresponding forced portion when the movable plate moves from the first position to the second position. Therefore, even thought the keyswitch modules of different specifications on the keyboard have different horizontal movements, each of the distances can be adjusted to make the sum of each of the distances and the corresponding horizontal movement be equal to the horizontal stroke with which the movable plate moves from the first position to the second position, so as to achieve the purpose of lowering keyswitch modules of different specifications by the same height to reduce the whole thickness of the keyboard.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
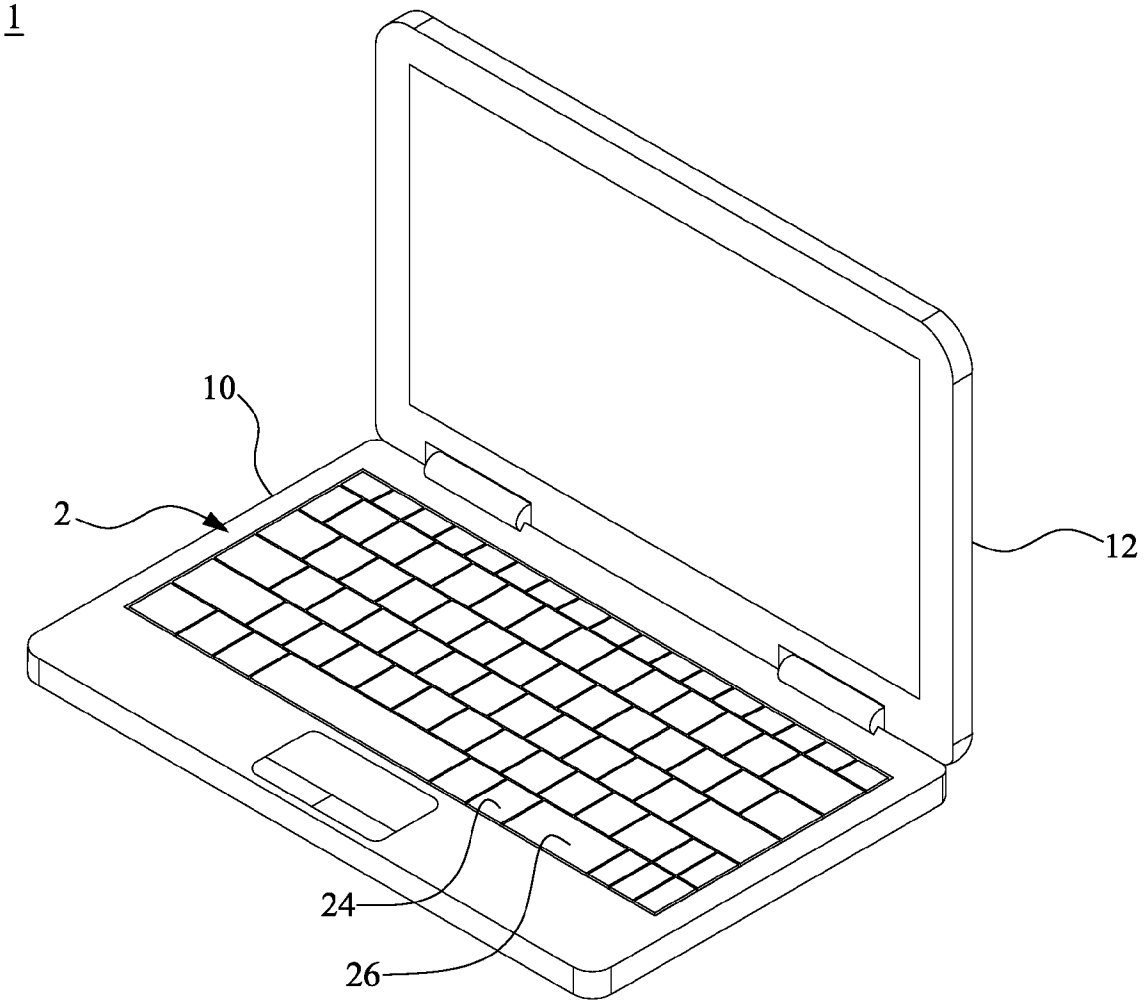
FIG. 1 is a perspective view of an electronic apparatus using a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a perspective view of an electronic apparatus 1 using a keyboard 2 according to an embodiment of the disclosure.

As shown in FIG. 1, in the embodiment, the electronic apparatus 1 includes a host 10, a display 12, and a keyboard 2. The keyboard 2 is disposed on the host 10 and at least includes a first keyswitch module 24 and a second keyswitch module 26 of different specifications. An edge of the display 12 is pivotally connected to an edge of the host 10, so that the display 12 can rotate to expand or collapse relative to the host 10. When the display 12 rotates relative to the host 10 to collapse, the keyboard 2 is covered by the display 12, and the first keyswitch module 24 and the second keyswitch module 26 are switched to a closing status. When the display 12 rotates relative to the host 10 to expand, the keyboard 2 is exposed, and the first keyswitch module 24 and the second keyswitch module 26 are switched to an opening status. The mechanism of switching the first keyswitch module 24 and the second keyswitch module 26 to the opening status or the closing status is introduced in detail below.

In the embodiment, the electronic apparatus 1 takes a portable notebook computer as an example, but the disclosure is not limited in this regard.

Figure 2:
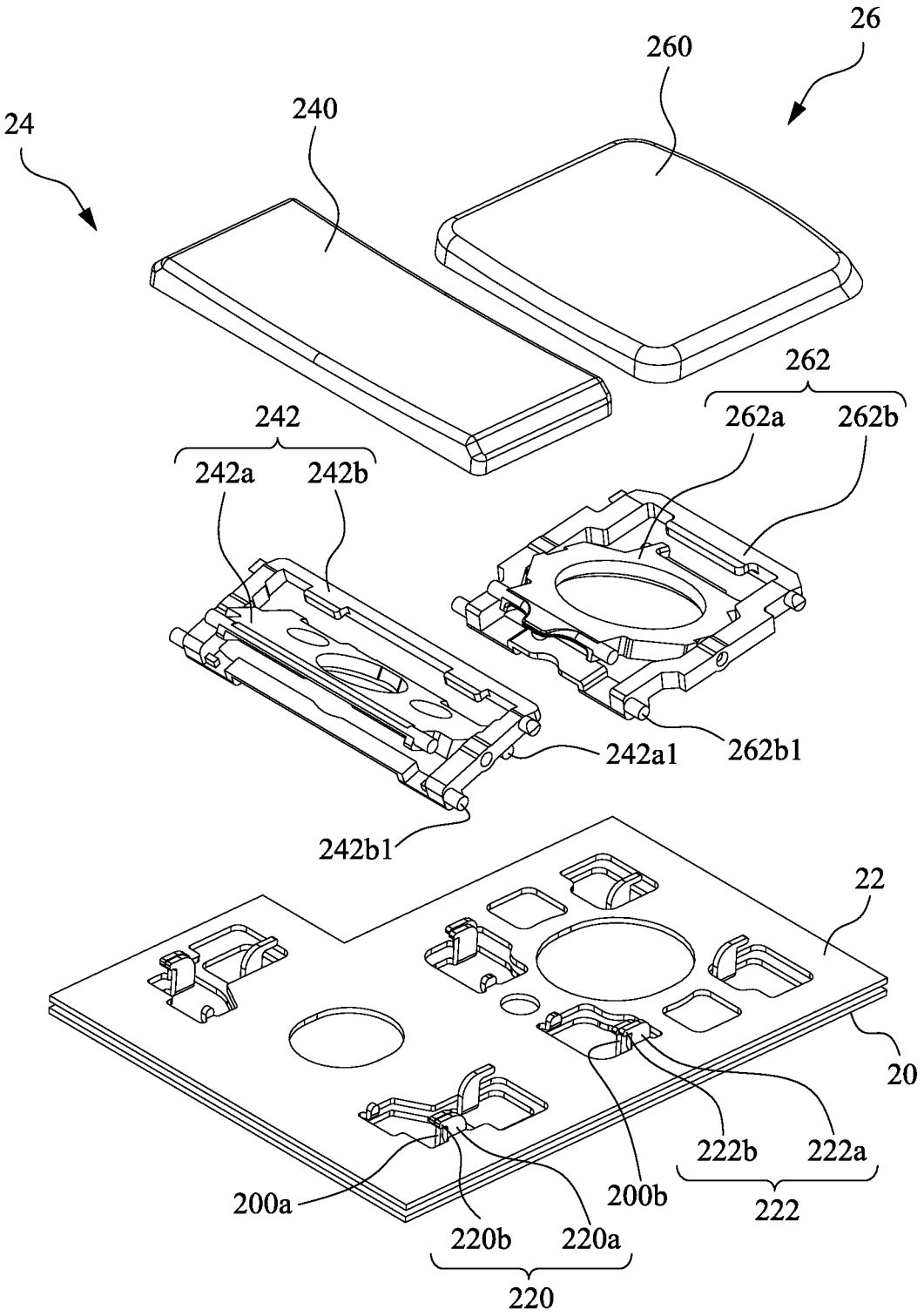
FIG. 2 is an exploded view of a first keyswitch module and a second keyswitch module in FIG. 1.
Figure 3A:
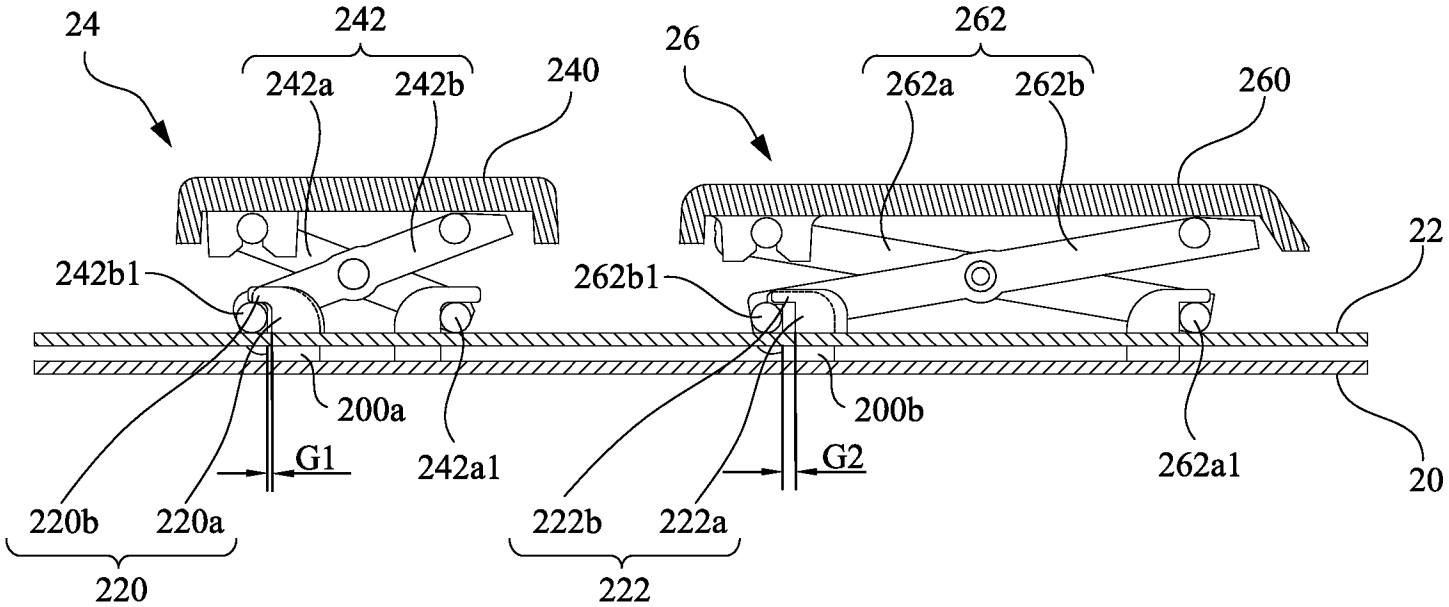
FIG. 3A is a cross-sectional view of the keyboard in FIG. 1, in which a movable plate is located at a first position, and a first keycap of the first keyswitch module and a second keycap of the second keyswitch are located at an opening position.
Figure 3B:
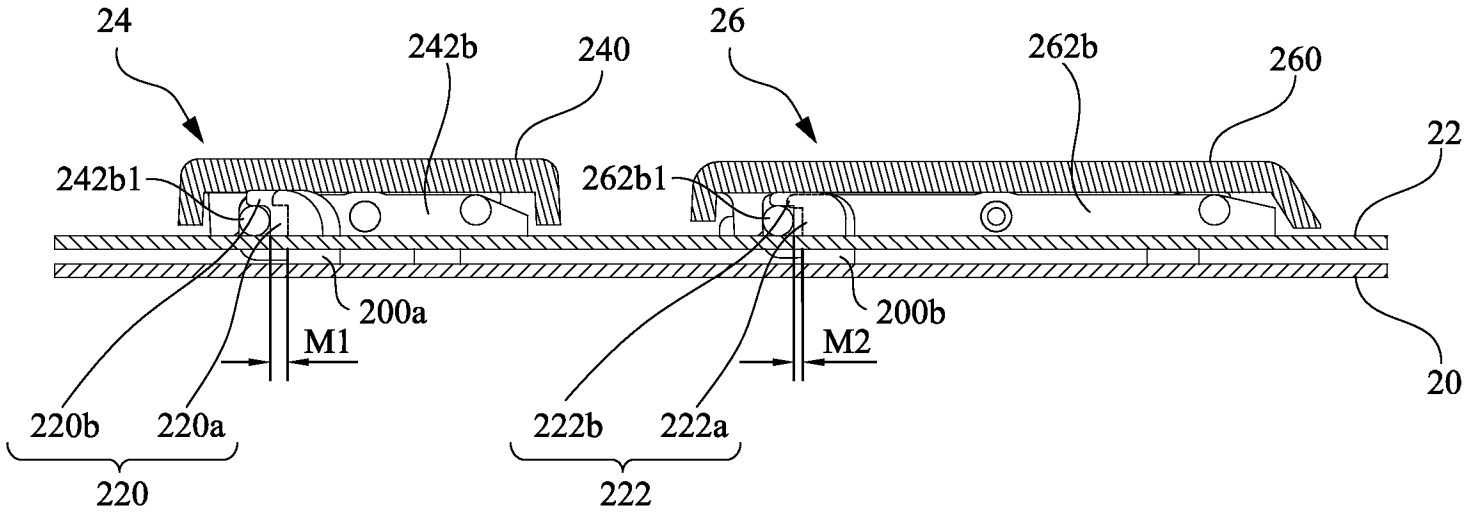
FIG. 3B is another cross-sectional view of the keyboard in FIG. 1, in which the movable plate is located at a second position, and the first keycap of the first keyswitch module and the second keycap of the second keyswitch are located at a closing position.
Figure 3C:
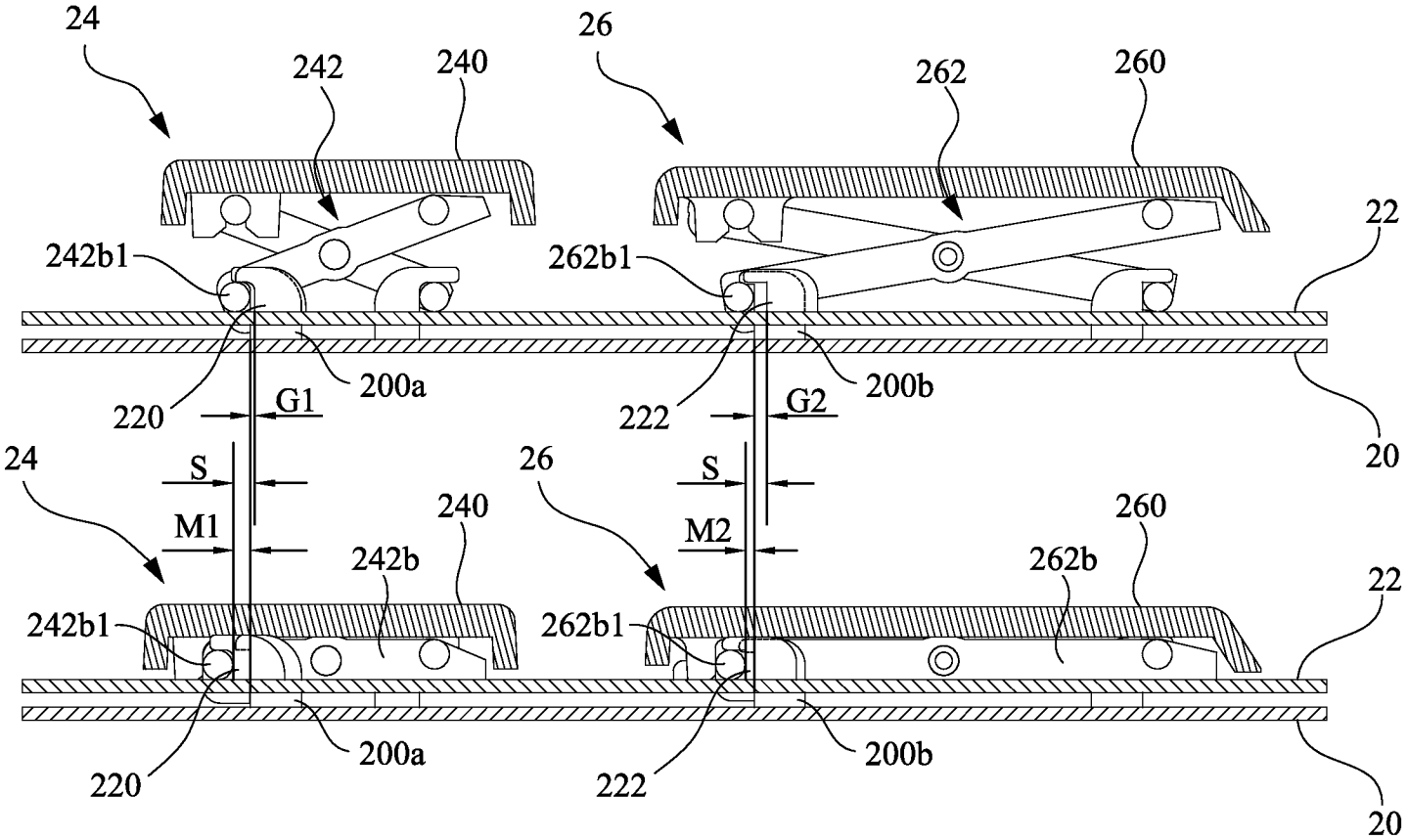
FIG. 3C shows a comparison of FIG. 3A and FIG. 3B.

FIG. 2 is an exploded view of the first keyswitch module 24 and the second keyswitch module 26 in FIG. 1. FIG. 3A is a cross-sectional view of the keyboard in FIG. 1, in which a movable plate 22 is located at a first position, and a first keycap 240 of the first keyswitch module 24 and a second keycap 260 of the second keyswitch 26 are located at an opening position. FIG. 3B is another cross-sectional view of the keyboard 2 in FIG. 1, in which the movable plate 22 is located at a second position, and the first keycap 240 of the first keyswitch module 24 and the second keycap 260 of the second keyswitch 26 are located at a closing position. FIG. 3C shows a comparison of FIG. 3A and FIG. 3B.

As shown in FIG. 3A to FIG. 3C, in the embodiment, the keyboard 2 includes a bottom plate 20, the movable plate 22, the first keycap 240, a first connecting assembly 242, the second keycap 260, and a second connecting assembly 262. The combination of the bottom plate 20, the movable plate 22, the first keycap 240, and the first connecting assembly 242 can be regarded as the first keyswitch module 24, and the combination of the bottom plate 20, the movable plate 22, the second keycap 260, and the second connecting assembly 262 can be regarded as the second keyswitch module 26. The keyboard 2 can further includes a membrane circuit board (not shown) for generating trigger signals. Reset members (not shown) can be further disposed under the first keycap 240 and the second keycap 260 for resetting the positions of the first keycap 240 and the second keycap 260. The reset members are common components in the keyboard 2, so they are not discussed here. The first keyswitch module 24 and the second keyswitch module 26 are introduced in detail below.

The movable plate 22 is stacked with the bottom plate 20 and capable of moving between the first position (as shown in FIG. 3A) and the second position relative to the bottom plate (as shown in FIG. 3B). In the embodiment, the movable plate 22 is disposed on the bottom plate 20. In some embodiments, the movable plate 22 is disposed under the bottom plate 20. The first keyswitch module 24 and the second keyswitch module 26 are switched to the opening status when the movable plate 22 is located at the first position, and the first keyswitch module 24 and the second keyswitch module 26 are switched to the closing status when the movable plate 22 is located at the second position. The movable plate 22 includes a first forcing structure 220 and a second forcing structure 222. The first forcing structure 220 and the second forcing structure 222 are respectively located under the first keycap 240 and the second keycap 260.

The first connecting assembly 242 is operatively connected to the bottom plate 20 and the movable plate 22, and is connected to the first keycap 240. The first connecting assembly 242 includes a first forced portion 242*b*1 configured to be moved by the first forcing structure 220, so as to make the first keycap 240 vertically move between the opening position and the closing position relative to the bottom plate 20. Particularly, in the embodiment, the first connecting assembly 242 is a scissors-like connecting assembly and includes a first connecting member 242*a* and a second connecting member 242*b*. The first connecting member 242*a* and the second connecting member 242*b* are pivotally connected to each other. The first connecting member 242*a* has a first pivotal end 242*a*1 pivotally connected to the bottom plate 20. In the embodiment, the first forced portion 242*b*1 is a sliding end of the second connecting member 242*b*. In some embodiments, a pivotal end can also be a forced portion of a connecting assembly. The first forced portion 242*b*1 can slides relative to the bottom plate 20. When the first connecting assembly 242 rises or lowers the first keycap 240 relative to the bottom plate 20, the distance between the first pivotal end 242*a*1 and the first forced portion 242*b*1 is correspondingly changed.

In the embodiment, the bottom plate 20 includes a first stopping structure 200*a* and a second stopping structure 200*b*. The first forcing structure 220 includes a first pushing portion 220*a* and a first retaining portion 220*b*. The first pushing portion 220*a* is configured to push the first forced portion 242*b*1. When the movable plate 22 is located at the first position, the first forced portion 242*b*1 abuts against the first stopping structure 200*a* to make the first keycap 240 be located at the opening position, and the first pushing portion 220*a* and the first forced portion 242*b*1 are separated by a first distance G1 (as shown in FIG. 3A). The first retaining portion 220*b* is connected to the first pushing portion 220*a* and slidably engaged with the first forced portion 242*b*1, so as to retain the first forced portion 242*b*1 relative to the bottom plate 20.

In some embodiments, the first forced portion 242*b*1 can also be another portion of the first connecting assembly 242 or a protruding structure additionally disposed on the first connecting assembly 242, rather than be limited to the sliding end of the second connecting member 242*b*.

The second connecting assembly 262 is operatively connected to the bottom plate 20 and the movable plate 22, and is connected to the second keycap 260. The second connecting assembly 262 includes a second forced portion 262*b*1 configured to be moved by the second forcing structure 222, so as to make the second keycap 260 vertically move between the opening position and the closing position relative to the bottom plate 20. Particularly, in the embodiment, the second connecting assembly 262 is a scissors-like connecting assembly and includes a third connecting member 262*a* and a fourth connecting member 262*b*. The third connecting member 262*a* and the fourth connecting member 262*b* are pivotally connected to each other. The third connecting member 262*a* has a second pivotal end 262*a*1 pivotally connected to the bottom plate 20. The second forced portion 262*b*1 is a sliding end of the fourth connecting member 262*b*. The second forced portion 262*b*1 can slides relative to the bottom plate 20. When the second connecting assembly 262 rises or lowers the second keycap 260 relative to the bottom plate 20, the distance between the second pivotal end 262*a*1 and the second forced portion 262*b*1 is correspondingly changed.

In the embodiment, the second forcing structure 222 includes a second pushing portion 222*a* and a second retaining portion 222*b*. The second pushing portion 222*a* is configured to push the second forced portion 262*b*1. When the movable plate 22 is located at the first position, the second pushing portion 222*a* and the second forced portion 262*b*1 are separated by a second distance G2 (as shown in FIG. 3A). The second retaining portion 222*b* is connected to the second pushing portion 222*a* and slidably engaged with the second forced portion 262*b*1, so as to retain the second forced portion 262*b*1 relative to the bottom plate 20.

In some embodiments, the second forced portion 262*b*1 can also be another portion of the second connecting assembly 262 or a protruding structure additionally disposed on the second connecting assembly 262, rather than be limited to the sliding end of the fourth connecting member 262*b*.

In the embodiment, the first keyswitch module 24 and the second keyswitch module 26 have different specifications, so the first forced portion 242*b*1 and the second forced portion 262*b*1 respectively move different strokes from the opening position to the closing position.

As shown in FIG. 3A, when both of the first keycap 240 and the second keycap 260 are located at the opening position and the movable plate 22 is located at the first position, the first forcing structure 220 and the first forced portion 242*b*1 are separated by the first distance G1, and the second forcing structure 222 and the second forced portion 262*b*1 are separated by the second distance G2. Meanwhile, both of the first keyswitch module 24 and the second keyswitch module 26 are in the opening status.

As shown in FIG. 3A to FIG. 3C, when moving from the first position to the second position (as progressing from FIG. 3A to FIG. 3B), the movable plate 22 moves a horizontal stroke S. During the movement, the first forcing structure 220 pushes the first forced portion 242*b*1 of the second connecting member 242*b* to leave the first stopping structure 200*a* and moves for a first horizontal movement M1, and the second forcing structure 222 pushes the second forced portion 262*b*1 of the fourth connecting member 262*b* to leave the second stopping structure 200*b* and moves for a second horizontal movement M2, so as to move the first keycap 240 and the second keycap 260 to the closing position. Meanwhile, both of the first keyswitch module 24 and the second keyswitch module 26 are in the closing status.

It is noted that if the vertical positions of the keyswitch modules are controlled by using a movable plate, problems might occur due to differences of the keyswitch modules with different specifications. If using a single movable plate to control the vertical positions, different requirements of movement of the keyswitch modules cannot be satisfied because the movable plate moves the same stroke relative to all of the keyswitch modules. If using a plurality of movable plates to control the vertical positions, difficulties of manufacturing, assembling, and controlling the movable plates bother users. The embodiment is designed to make both of the sum of the first distance G1 and the first horizontal movement M1 and the sum of the second distance G2 and the second horizontal movement M2 be equal to the horizontal stroke S. Therefore, even thought the first keyswitch module 24 and the second keyswitch module 26 that have different specifications on the keyboard 2 respectively have the first horizontal movement M1 and the second horizontal movement M2 different from each other, the first distance G1 and the second distance G2 can be adjusted to make the sum of each of the distances and the corresponding horizontal movement be equal to the horizontal stroke S with which the movable plate 22 moves from the first position to the second position, so as to achieve the purpose of lowering the first keyswitch module 24 and the second keyswitch module 26 that have different specifications by the same height to reduce the whole thickness of the keyboard 2.

In the embodiment, the first distance G1 is larger than 0, and the second distance G2 is larger than the first distance G1, but the disclosure is not limited in this regard. In some embodiments, if the horizontal stroke S of which the movable plate 22 moves from the first position to the second position is reduced, the foregoing first distance G1 can be further reduced to 0, and the foregoing second distance G2 can be correspondingly subtracted the first distance G1.

It is noted that during the movement of the movable plate 22 from the first position to the second position, because the first distance G1 and the second distance G2 are different, the first forcing structure 220 and the second forcing structure 222 of the movable plate 22 respectively push the first forced portion 242*b*1 and the second forced portion 262*b*1 at different times (i.e., the first keycap 240 and the second keycap 260 are lowered at different times). However, the purpose of the disclosure can be achieved as long as the first keycap 240 and the second keycap 260 are finally lowered with the same height difference.

In another embodiment, at least one of the first connecting assembly 242 and the second connecting assembly 262 is a parallel linkage assembly. As long as the sum of each of the distances and the corresponding horizontal movement is designed to be equal to the horizontal stroke S with which the movable plate 22 moves from the first position to the second position, the purpose of lowering the first keyswitch module 24 and the second keyswitch module 26 that have different specifications by the same height to reduce the whole thickness of the keyboard 2 can be achieved.

According to the foregoing recitations of the embodiments of the disclosure, it can be seen that the keyswitch module and the keyboard of the disclosure can achieve the purpose of adjusting the height of keycaps relative to a bottom plate by horizontally moving a movable plate between a first position and a second position. When the keyboard is not used and needs to be received, a user can move the movable plate from the first position to the second position to make forcing structures on the movable plate push forced portions on connecting assemblies of keyswitch modules, so as to move the keycaps lower from an opening position to a closing position relative to the bottom plate. Meanwhile, the keycaps are at the smallest height relative to the bottom plate. When the keyboard is opened to use, the user can move the movable plate from the second position to the first position to make the forcing structures release the forced portions of the connecting assemblies, so as to move the keycaps rise from the closing position to the opening position relative to the bottom plate. Meanwhile, the keycaps are at the largest height relative to the bottom plate. Furthermore, when the movable plate of the keyboard is located at the first position, each of the forcing structures and the corresponding forced portion are separated by a distance, and the distance is determined by the horizontal movement with which each of the forcing structures pushes the corresponding forced portion when the movable plate moves from the first position to the second position. Therefore, even thought the keyswitch modules of different specifications on the keyboard have different horizontal movements, each of the distances can be adjusted to make the sum of each of the distances and the corresponding horizontal movement be equal to the horizontal stroke with which the movable plate moves from the first position to the second position, so as to achieve the purpose of lowering keyswitch modules of different specifications by the same height to reduce the whole thickness of the keyboard.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyswitch module, comprising:

a bottom plate;

a moveable plate stacked with the bottom plate and capable of moving between a first position and a second position relative to the bottom plate, wherein the moveable plate moves a horizontal stroke from the first position to the second position, and the moveable plate comprises a forcing structure;

a keycap; and a connecting assembly operatively connected to the bottom plate and connected to the keycap, wherein the connecting assembly comprises a forced portion configured to be moved by the forcing structure, so as to make the keycap vertically move between an opening position and a closing position relative to the bottom plate, wherein when the moveable plate is located at the first position, the forcing structure and the forced portion are separated by a distance larger than 0, and the keycap is located at the opening position, and wherein when the keycap is located at the opening position and the moveable plate moves from the first position to the second position, the forcing structure pushes the forced portion to move a horizontal movement and moves the keycap to the closing position, and the sum of the distance and the horizontal movement is equal to the horizontal stroke.

2. The keyswitch module of claim 1, wherein the moveable plate is stacked on the bottom plate.

3. The keyswitch module of claim 1, wherein the connecting assembly is a scissors-like connecting assembly.

4. The keyswitch module of claim 1, wherein the connecting assembly comprises a first connecting member and a second connecting member pivotally connected to each other, the first connecting member has a pivotal end pivotally connected to the bottom plate, the forced portion is a sliding end of the second connecting member, and the forced portion is slidably disposed above the bottom plate.

5. The keyswitch module of claim 1, wherein the forcing structure comprises:

a pushing portion configured to push the forced portion, wherein when the moveable plate is located at the first position, the pushing portion and the forced portion are separated by the distance and a retaining portion, connected to the pushing portion and slidably engaged with the forced portion, configured to retain the forced portion relative to the bottom plate.

6. The keyswitch module of claim 1, wherein the connecting assembly is a parallel linkage assembly.

7. A keyboard, comprising:

a bottom plate;

a moveable plate stacked with the bottom plate and capable of moving between a first position and a second position relative to the bottom plate, wherein the moveable plate moves a horizontal stroke from the first position to the second position, and the moveable plate comprises a first forcing structure and a second forcing structure;

a first keycap;

a first connecting assembly operatively connected to the bottom plate and connected to the first keycap, wherein the first connecting assembly comprises a first forced portion configured to be moved by the first forcing structure, so as to make the first keycap vertically move between an opening position and a closing position relative to the bottom plate;

a second keycap; and a second connecting assembly operatively connected to the bottom plate and connected to the second keycap, wherein the second connecting assembly comprises a second forced portion configured to be moved by the second forcing structure, so as to make the second keycap vertically move between an opening position and a closing position relative to the bottom plate, wherein when the moveable plate is located at the first position, the first forcing structure and the first forced portion are separated by a first distance, the second forcing structure and the second forced portion are separated by a second distance different from the first distance, and the first keycap and the second keycap are located at the opening position, and wherein when the first keycap and the second keycap are located at the opening position and the moveable plate moves from the first position to the second position, the first forcing structure pushes the first forced portion to move a first horizontal movement and moves the first keycap to the closing position, the second forcing structure pushes the second forced portion to move a second horizontal movement and moves the second keycap to the closing position, and both of the sum of the first distance and the first horizontal movement and the sum of the second distance and the second horizontal movement are equal to the horizontal stroke.

8. The keyboard of claim 7, wherein the moveable plate is stacked on the bottom plate.

9. The keyboard of claim 7, wherein the first distance is equal to or larger than 0, and the second distance is larger than the first distance.

10. The keyboard of claim 7, wherein at least one of the first connecting assembly and the second connecting assembly is a scissors-like connecting assembly.

11. The keyboard of claim 7, wherein the first connecting assembly comprises a first connecting member and a second connecting member pivotally connected to each other, the first connecting member has a first pivotal end pivotally connected to the bottom plate, the first forced portion is a sliding end of the second connecting member, the first forced portion is slidably disposed above the bottom plate, the second connecting assembly comprises a third connecting member and a fourth connecting member pivotally connected to each other, the third connecting member has a second pivotal end pivotally connected to the bottom plate, the second forced portion is a sliding end of the fourth connecting member, and the second forced portion is slidably disposed above the bottom plate.

12. The keyboard of claim 7, wherein the first forcing structure comprises:

a first pushing portion configured to push the first forced portion, wherein when the moveable plate is located at the first position, the first pushing portion and the first forced portion are separated by the first distance; and a first retaining portion, connected to the first pushing portion, for retaining the first forced portion relative to the bottom plate.

13. The keyboard of claim 7, wherein the second forcing structure comprises:

a second pushing portion configured to push the second forced portion, wherein when the moveable plate is located at the first position, the second pushing portion and the second forced portion are separated by the second distance; and a second retaining portion, connected to the second pushing portion and slidably engaged with the second forced portion, configured to retain the second forced portion relative to the bottom plate.

14. The keyboard of claim 7, wherein at least one of the first connecting assembly and the second connecting assembly is a parallel linkage assembly.

* * * * *